US009540851B2

(12) United States Patent
Lee

(10) Patent No.: US 9,540,851 B2
(45) Date of Patent: Jan. 10, 2017

(54) APPARATUS OF SLIDE DOOR FOR VEHICLE

(71) Applicant: Hyundai Motor Company, Seoul (KR)

(72) Inventor: Kyeong Ho Lee, Gwangju (KR)

(73) Assignee: Hyundai Motor Company, Seoul (KR)

( * ) Notice: Subject to any disclaimer, the term of this patent is extended or adjusted under 35 U.S.C. 154(b) by 133 days.

(21) Appl. No.: 14/265,262

(22) Filed: Apr. 29, 2014

(65) Prior Publication Data

US 2015/0152673 A1 Jun. 4, 2015

(30) Foreign Application Priority Data

Nov. 29, 2013 (KR) ..... 10-2013-0147280

(51) Int. Cl.
*E05C 3/06* (2006.01)
*E05B 79/20* (2014.01)
*E05B 83/04* (2014.01)

(52) U.S. Cl.
CPC ..... *E05B 79/20* (2013.01); *E05B 83/04* (2013.01); *Y10T 292/1047* (2015.04)

(58) Field of Classification Search
CPC ..... E05Y 2201/674; Y10T 292/0862; Y10T 292/0863; Y10T 292/0878; Y10T 292/0886; E05B 83/40; E05C 17/60
USPC ..... 292/216, 201, DIG. 23, 207
See application file for complete search history.

(56) References Cited

U.S. PATENT DOCUMENTS 4,502,246 A * 3/1985 Minami ..... E05C 17/50 49/213
5,967,595 A * 10/1999 Heya ..... B60J 5/06 296/155
5,979,971 A * 11/1999 Mizuki ..... E05B 65/0811 292/219
6,412,222 B1 * 7/2002 Hashiba ..... B60J 5/06 296/155

FOREIGN PATENT DOCUMENTS

| | | | |
|---|---|---|---|
| JP | 9-228714 | A | 9/1997 |
| JP | 2005-155076 | A | 6/2005 |
| JP | 2008-169582 | A | 7/2008 |
| KR | 10-2005-0037128 | A | 4/2005 |
| KR | 10-2007-0020783 | A | 2/2007 |

* cited by examiner

*Primary Examiner* — Mark Williams
(74) *Attorney, Agent, or Firm* — Morgan, Lewis & Bockius LLP

(57) ABSTRACT

An apparatus of a slide door for a vehicle may include a rail formed at a frame of a vehicle body and a striker formed at one side of the rail, a latch arm formed at the door and a roller that is connected to the latch arm to be slid along the rail to open/close the door, and a latch of a hook shape which is connected to the latch arm to be caught over or released from the striker.

5 Claims, 3 Drawing Sheets

APPARATUS OF SLIDE DOOR FOR VEHICLE

CROSS REFERENCE TO RELATED APPLICATION

The present application claims priority of Korean Patent Application Number 10-2013-0147280 filed on Nov. 29, 2013, the entire contents of which application are incorporated herein for all purposes by this reference.

BACKGROUND OF INVENTION

Field of Invention

The present disclosure relates to an apparatus of a slide door for a vehicle, which is related to a latch and a striker for fixing or releasing an opened state of a slide door.

Description of Related Art

Generally, a latch and a striker are provided on a vehicle equipped with a slide door to fix the door while it is opened for user's convenience when a passenger gets on and off a vehicle or loads and unloads luggage. In Korean Patent Laid-open No. 10-2005-0037128 A, a hold open lock device of a slide door has been disclosed, including a link lever, a control lever, a locking lever, and a locking lever spring.

However, the apparatus of a slide door for a vehicle according to the related art is consisted of a number of components in addition to a latch and a striker, as well as the above components, and thus its structure is complex and a sufficient mounting space have to be secured and further an opening amount of a door is reduced. Accordingly, a need exists for an apparatus of a slide door for a vehicle which is simple and does not occupy a wide space, and can maximize the opening amount of a door.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention have been proposed to solve above or other drawbacks and to provide an apparatus of a slide door for a vehicle which can maximize an opening amount of a door while it is simple and does not occupy a wide space.

Various aspects of the present invention provide for an apparatus of a slide door for a vehicle of the present invention may include: a rail formed at a frame of a vehicle body and a striker formed at one side of the rail, a latch arm formed at the door and a roller that is connected to the latch arm to be slid along the rail to open/close the door, and a latch of a hook shape which is connected to the latch arm to be caught over or released from the striker.

The striker may have a shape of a column and may be fixed to the frame of the vehicle body. A supporter of a column shape may be provided at an upper part of the latch arm wherein one side of the supporter is combined to an upper surface of the latch arm and the other side thereof is through-combined to a roller. The latch may be through-combined to the supporter.

A cable connected to a handle of the door may be combined to the latch at an end of the cable such that the latch may be released from the striker when the handle operates. An elastic member may be combined to the latch such that the latch may be caught over or released from the striker elastically.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other features of the present invention will now be described in detail with reference to certain exemplary embodiments thereof illustrated the accompanying drawings which are given hereinbelow by way of illustration only, and thus are not limitative of the present invention, and wherein.

Figure 1:
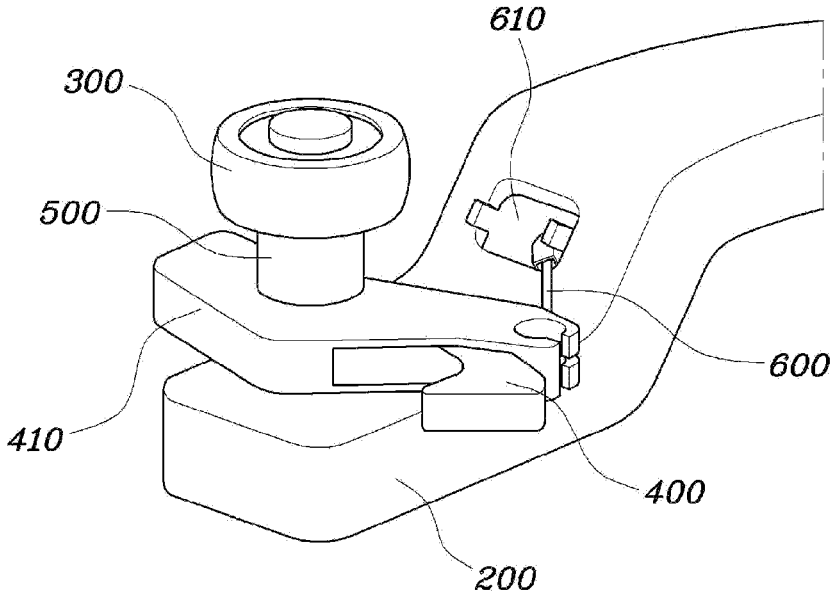
FIG. 1 is a perspective view showing an exemplary apparatus of a slide door for a vehicle according to the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 2:
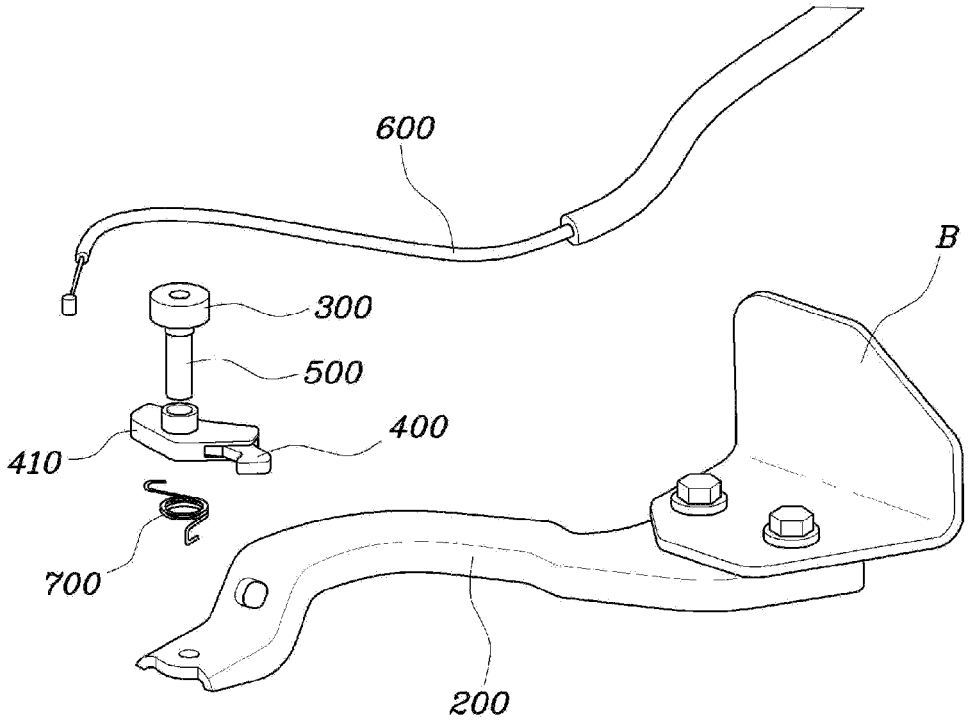
FIG. 2 is an exploded perspective view of FIG. 1.

FIG. 1 is a perspective view showing an apparatus of a slide door for a vehicle according to various exemplary embodiments of the present invention, FIG. 2 is an exploded perspective view of FIG. 1, and FIGS. 3 to 5 are views showing catching procedures of a latch and a striker.

The apparatus of a slide door for a vehicle according to various exemplary embodiments of the present invention includes: a rail formed at a frame of a vehicle body and a striker 100 formed at one side of the rail; a latch arm 200 formed at the door and a roller 300 that is connected to the latch arm 200 to be slid along the rail to open/close the door; and a latch 400 of a hook shape which is connected to the latch arm 200 so as to be caught over or released from the striker 100. A slide door is connected to a frame of a vehicle body to be slid front/rearward wherein a rail is formed on the frame of a vehicle body for such a movement and the roller 300 is provided on the door to be slid along the rail to open/close the door.

Here, the striker 100 is provided on one side of the rail of a frame of a vehicle body and the latch 400 is provided on the door wherein the latch 400 is caught over the striker 100 thereby to maintain continuously an opening state of the door after the door is opened.

Figure 3:
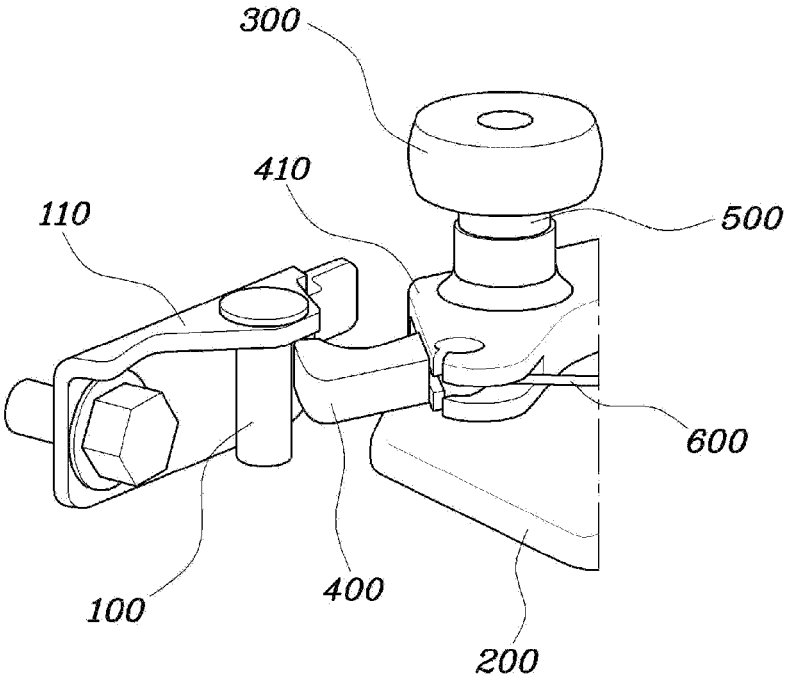
FIG. 3 is a view showing catching procedures of an exemplary latch and an exemplary striker.
Figure 4:
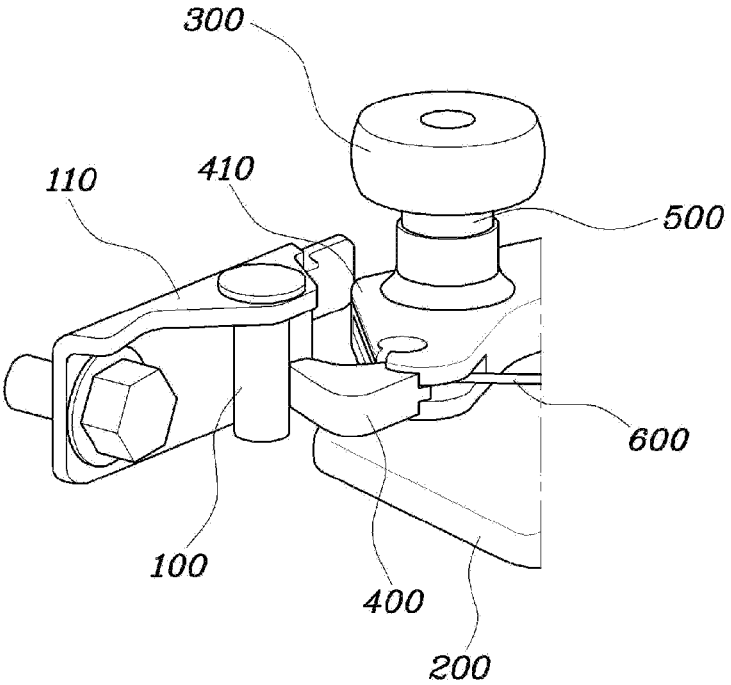
FIG. 4 is a view showing catching procedures of an exemplary latch and an exemplary striker.
Figure 5:
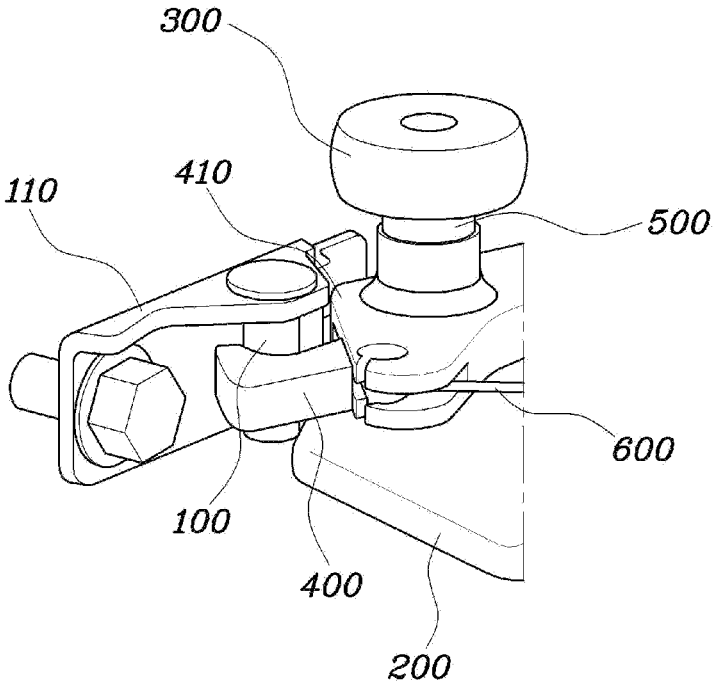
FIG. 5 is a view showing catching procedures of an exemplary latch and an exemplary striker.

As shown in FIGS. 3-5, the striker 100 has a shape of a column and is fixed to a frame of a vehicle body using the bracket 110, etc., and the latch 400 has a shape of a hook and is fixed while the door is opened when an opening surface of the hook is caught along an outer peripheral surface at the side of the striker 100.

The latch arm 200 is fixed to the door through a bracket B and the shape of the bracket, similar to "L" character, may minimize the space for bracket B and supports the latch arm 200 more tightly. Additionally, the design degree of the apparatus may be improved since the shape of the latch arm 200 may be designed freely and reduction of an opening amount of a door can be prevented by the latch arm 200

Here, a supporter 500 of a column shape is provided at the upper part of the latch arm 200 to be connected vertically thereto wherein one side of the supporter 500 is combined to the upper surface of the latch arm 200 and the other side thereof is through-combined to a roller 300. The latch 400 combined to a latch housing 410 is through-combined to the lower side of the supporter 500. The roller 300 of a column shape is through-combined to the supporter 500 through a through-hole formed at a middle thereof, and thus is rotated along the roller 300 to be slid within a rail.

A cable 600 connected to a handle of the door is combined or coupled to the latch 400 and an end of the cable 600 is combined to the latch 400, and thus the latch 400 is released from the striker 100 when the handle operates. In the present embodiment of the present invention it is shown that the latch 400 is combined to the latch housing 410 and a through-hole is formed at one side of the latch housing 410 and that the cable 600 is connected therethrough, however the above configurations may be changed according to design or environment without limitation.

Additionally, an elastic member 700 is combined or coupled to the latch 400 and thus the latch 400 can be caught over or released from the striker 100 elastically wherein it is shown that an elastic member 700 is combined within the latch housing 410 in an embodiment of the present invention.

FIGS. 3 to 5 are views showing catching procedures of a latch 400 and a striker 100, and it can be seen in FIG. 3 that the backside of a hook shape of the latch 400 is in contact with the striker 100. Under the state of FIG. 3, when the door slides continuously, the backside of a hook shape of the latch 400 is compressed by the elastic member 700 combined to the latch 400 to pass over the striker 100. However, by the nature of the elastic member 700 to return to its original state, the hook of the latch 400 is caught at the circumference of the striker 100 thereby to maintain an opened state of the door.

Meanwhile, a handle mounted to the door is pulled in order to close the door of a vehicle and the latch 400 is pulled by the cable 600 connected to the handle, and the catching of the striker 100 and the latch 400 is released, allowing the door to be slid for closing.

Accordingly, according to an apparatus for a slide door of a vehicle of various exemplary embodiments of the present invention, only the hook of the latch to be caught over the striker is rotated at a predetermined angle thereby to reduce the sizes of the components to decrease the required space, unlike a conventional latch which is mounted separately, the sizes of the components of which are great and which requires a wide space when it is rotated.

According to an apparatus for a slide door of a vehicle of the present invention, a supporter is provided on the latch arm and a latch and a roller are molded to be through-combined to the supporter integrally or monolithically thereby to reduce the number of the components. Accordingly, the structure may be simplified, workability may be improved and the production process may be simplified, saving cost.

Additionally, according to an apparatus for a slide door of a vehicle of the present invention, a design freedom is increased by designing a height of a latch arm to be high while reducing a space occupied by the components with decreasing a width of the latch arm and the latch arm can support more firmly the latch.

Accordingly, an opening amount of a door can be increased by reducing a width of the latch arm width and customer satisfaction can be increased through easy access of passengers and freights to a vehicle, which can improve the brand image.

For convenience in explanation and accurate definition in the appended claims, the terms "upper" or "lower", "front" or "rear", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An apparatus of a slide door for a vehicle comprising:

a rail formed at a frame of a vehicle body and a striker formed at one side of the rail;

a latch arm formed at the door and a roller connected to the latch arm to be slid along the rail to open/close the door; and a latch having a hook shape, the latch pivotally connected to the latch arm to be caught over or released from the striker, wherein a supporter having a column shape is provided at an upper part of the latch arm, wherein a first side of the supporter is combined to an upper surface of the latch arm and a second side thereof is through-combined to the roller, and wherein the latch is through-combined to the supporter.

2. The apparatus of a slide door for a vehicle of claim 1, wherein the striker has a shape of a column and is fixed to the frame of the vehicle body.

3. The apparatus of a slide door for a vehicle of claim 1, wherein a cable connected to a handle of the door is combined to the latch at an end of the cable such that the latch is to be released from the striker when the handle operates.

4. The apparatus of a slide door for a vehicle of claim 1, wherein an elastic member is combined to the latch such that the latch is to be caught over or released from the striker elastically.

5. The apparatus of a slide door for a vehicle of claim 1, wherein the first side of the supporter is directly combined to the upper surface of the latch arm.

* * * * *